US006626653B2

(12) United States Patent
Lin et al.

(10) Patent No.: US 6,626,653 B2
(45) Date of Patent: Sep. 30, 2003

(54) BACKUP HEAT-DISSIPATING SYSTEM

(75) Inventors: Kuo-Cheng Lin, Taoyuan (TW); Shun-Chen Chang, Taipei (TW); Chih-Yuan Lin, Taipei (TW); Chun-Lung Chiu, Taoyuan Hsien (TW)

(73) Assignee: Delta Electronics Inc., Taoyuan Hsien (TW)

( * ) Notice: Subject to any disclaimer, the term of this patent is extended or adjusted under 35 U.S.C. 154(b) by 0 days.

(21) Appl. No.: 10/046,303

(22) Filed: Jan. 16, 2002

(65) Prior Publication Data

US 2002/0094280 A1 Jul. 18, 2002

Related U.S. Application Data

(63) Continuation-in-part of application No. 09/796,351, filed on Mar. 2, 2001.

(30) Foreign Application Priority Data

Jan. 17, 2001 (TW) ..... 90100991 A
Feb. 27, 2001 (TW) ..... 90202946 U

(51) Int. Cl.[7] ..... F04B 17/00; F04B 35/04

(52) U.S. Cl. ..... 417/423.5; 417/423.7; 415/199.4; 416/198 R; 361/687

(58) Field of Search ..... 417/423.5, 350, 417/354, 360, 423.7; 415/211.2, 199.1, 199.2, 199.4; 416/198 R, 244 R; 361/687, 695; 418/208.2, 209.1, 193, 223, 214.1, 247 R

(56) References Cited

U.S. PATENT DOCUMENTS

| | | | | | |
|---|---|---|---|---|---|
| 4,988,930 | A | * | 1/1991 | Oberheide | 318/82 |
| 5,099,181 | A | * | 3/1992 | Canon | 318/254 |
| 5,136,465 | A | * | 8/1992 | Benck et al. | 361/384 |
| 5,546,272 | A | * | 8/1996 | Moss et al. | 361/687 |
| 5,687,079 | A | * | 11/1997 | Bauer et al. | 364/175 |
| 6,101,459 | A | * | 8/2000 | Tavallaei et al. | 702/132 |
| 6,244,818 | B1 | * | 6/2001 | Chang | 415/208.2 |
| 6,396,688 | B1 | * | 5/2002 | Davies et al. | 361/687 |
| 6,400,045 | B1 | * | 6/2002 | Hosokawa et al. | 307/117 |

* cited by examiner

*Primary Examiner*—Timothy S. Thorpe
*Assistant Examiner*—Han L. Liu
(74) *Attorney, Agent, or Firm*—Birch, Stewart, Kolasch & Birch, LLP

(57) ABSTRACT

Disclosed is a backup heat-dissipating system having a serial fan which can be assembled easily, fastly and conveniently, and can effectively eliminate the interference between fans and prevent the air leakage resulting from the failed fan unit. The backup heat-dissipating system includes a main frame, a first rotor device disposed in the main frame and including a first control device, and a second rotor device disposed in the main frame to be coupled with the first rotor device in series along an axial direction of the main frame and including a second control device. When the first rotor device fails, the first control device will output a signal to the second control device for driving the second rotor device to rotate at a relatively higher speed.

20 Claims, 2 Drawing Sheets

BACKUP HEAT-DISSIPATING SYSTEM

The present invention is a continuation-in-part application of the parent application bearing Ser. No. 09/796,351 and filed on Mar. 2, 2001.

FIELD OF THE INVENTION

The present invention is related to a backup heat-dissipating system, and more particularly to a backup heat-dissipating system of an axial-flow fan with a plurality of rotor devices connected in series in a single fan guard.

BACKGROUND OF THE INVENTION

The axial-flow fan is a popular fan device which has the features of a simple structure, low cost, and a high airflow rate. Therefore, it has been widely used in various systems as an air conditioning or ventilating device, for instance, as a ventilation fan in a computer system.

Generally, in order to avoid the interruption of operation due to the breakdown of fans, a set of standby fan system is usually provided and connected with the original fan system in series to prevent the system or device from being damaged. Moreover, because the total pressure of the axial-flow fan is relatively low, the axial-flow fan cannot fully develop a high airflow rate in a system of a high resistance. Thus, in the case that a high total pressure is needed, two or more axial-flow fans are connected in series to provide the high total pressure.

Typically, a so-called serial fan is constituted by two independent fan units assembled through a specific circuit design. Each fan unit respectively includes a fan guard and a rotor device. After these two fan units are assembled respectively, both of them are coupled together through screws (not shown), thereby completing the construction of the serial fan. However, such a design is more complicated and needs more time and manufacturing cost in the assembly of this serial fan.

In fact, according to the above description, it can be found that the conventional serial fan is constructed by two independent fan units connected in series. However, the serial connection of two fan units can not guarantee that the total pressure of the airflow discharged from the fans can be doubled. Furthermore, although the rotation speed of one of the fan units can be increased when the other is failed so as to attain a certain heat-dissipating effect, the failed fan still unavoidably results in the air leakage of the entire heat-dissipating system and significantly affects its heat-dissipating ability.

Therefore, it is desirable to develop a backup heat-dissipating system that only occupies a small space, has a simplified structure, and can effectively eliminate the interference between the fans assembled in the heat-dissipating system without air leakage.

SUMMARY OF THE INVENTION

An object of the present invention is to provide a backup heat-dissipating system having a serial fan which can be assembled easily, fastly and conveniently, and has a strengthened bonding structure.

Another object of the present invention is to provide a backup heat-dissipating system of an axial-flow fan with a plurality of rotor devices connected in series in a single fan guard, which can effectively eliminate the interference between the fans.

Another yet object of the present invention is to provide a heat-dissipating system which has a backup function and can prevent the air leakage resulting from the failed fan unit.

According to the present invention, the backup heat-dissipating system includes a main frame, a first rotor device disposed in the main frame and including a first control device, and a second rotor device disposed in the main frame to be coupled with the first rotor device in series along an axial direction of the main frame and including a second control device. When the first rotor device is failed, the first control device will output a signal to the second control device for driving the second rotor device to rotate at a relatively higher speed.

The first rotor device and the second rotor device respectively further include a rotor vane with a plurality of fan blades and a motor for driving the rotor vane to rotate. The main frame has a first support and a second support to respectively receive the first and second rotor devices thereon.

Preferably, the first and second supports respectively have a base and a hollow cylinder substantially located at a center of the base thereof for receiving the motor and the rotor vane thereon. The first and second supports are respectively connected with the main frame through a plurality of guard blades radially arranged inside the main frame and fixed onto an inner surface of the main frame by each end thereof. Each of the plurality of guard blades has a shape substantially identical to that of each fan blade of the first and second rotor devices for enhancing a heat-dissipating efficiency. Preferably, the first support, the main frame and the plurality of guard blades are integrally formed together and are made of a material selected from one group consisting of plastic and metal, respectively.

In addition, the second support can be detachably connected with the first support through engagement.

Preferably, the first and second rotor devices are axial-flow fans, respectively.

Further scope of applicability of the present invention will become apparent from the detailed description given hereinafter. However, it should be understood that the detailed description and specific examples, while indicating preferred embodiments of the invention, are given by way of illustration only, since various changes and modifications within the spirit and of the scope of the invention will become apparent to those skilled in the art from this detailed description.

BRIEF DESCRIPTION OF THE DRAWINGS

The present invention may best be understood through the following description with reference to accompanying drawings which are given by way of illustration only, and thus are not limitative of the present invention, and in which.

DETAILED DESCRIPTION OF THE PREFERRED EMBODIMENT

The present invention will now be described more detailedly with reference to the following embodiments. It is to be noted that the following descriptions of the preferred embodiments of this invention are presented herein for the purpose of illustration and description only. It is not intended to be exhaustive or to be limited to the precise form disclosed.

Figure 1:
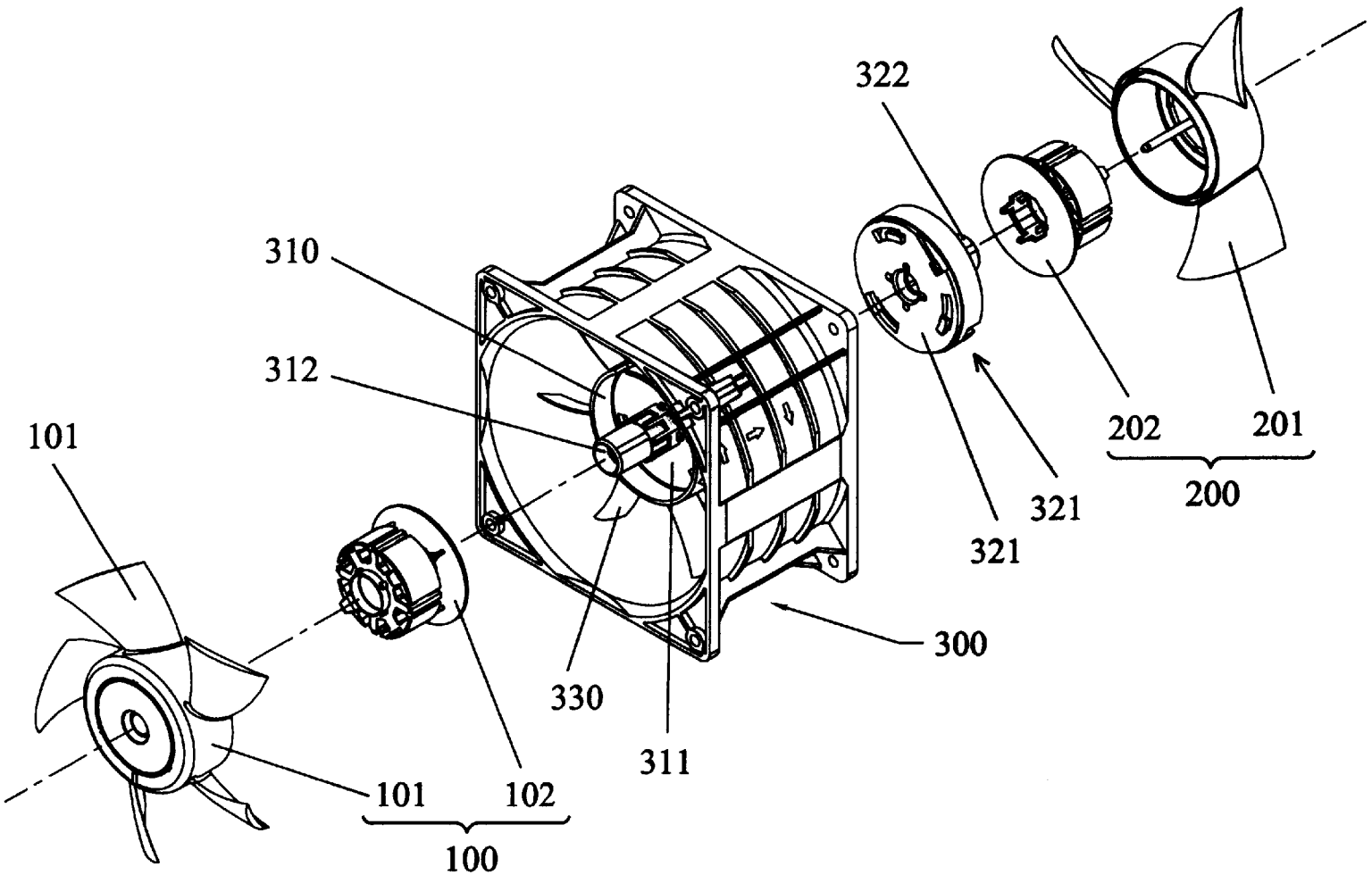
FIG. 1 is an exploded diagram showing a preferred embodiment of a backup heat-dissipating system according to the present invention.

Please refer to FIG. 1 which is an exploded diagram showing a preferred embodiment of a backup heat-dissipating system with a serial fan according to the present invention. The serial fan includes a main frame 300, a first rotor device 100, a second rotor device 200, a first support 310, and a second support 320. The first rotor device 100 includes a first rotor vane 101 with a plurality of fan blades formed around an outer side thereof and a first motor 102. Likewise, the second rotor device 200 includes a second rotor vane 201 with a plurality of fan blades formed around an outer side thereof and a second motor 202.

The first support 310 is connected and fixed within the main frame 300 through a plurality of guard blades 330 which are radially arranged inside the main frame 300 and fixed onto an inner surface of the main frame 300 by each end thereof. Each of the plurality of guard blades has a shape substantially identical to that of each blade of the rotor devices to increase the discharged airflow pressure of the fan for enhancing the heat-dissipating efficiency. The first support, the main frame and the plurality of guard blades can be integrally formed together and can be made of plastic, metal or a material other than plastic and metal for a desired purpose, respectively.

The first support 310 has a base 311 and a hollow cylinder 312 substantially located at a center of the base thereof for receiving the first motor 102 and the first rotor vane 101 thereon in sequence. The second support 320 also includes a base 321 and a hollow cylinder 322 substantially located at a center of the base thereof (similar to the first support) for receiving the second motor 202 and the second rotor vane 201 thereon in order. The second support can be made of plastic, metal or a material other than plastic and metal for a desired purpose.

When the first motor 102 for driving the first rotor vane 101 to rotate and the first rotor vane 101 are received by the first support 310 in sequence and then the second support 320 is combined with the first support 310 through the engagement between the retaining grooves of the first support 310 and the hook structures of the second support 320 to receive the second motor 202 for driving the second rotor vane 201 to rotate and the second rotor vane 201 thereon, the assembly of the serial fan is completed to construct an axial-flow fan and the first and second rotor devices are connected in series within the main frame 300 along the axial direction of the serial fan.

Because the second support 320 is detachably connected with the first support 310, it is only necessary to telescope the base of the second support 320 onto the base of the first support 310 such that the first and second supports can be tightly combined together without needing any screws or other parts. Therefore, in comparison with the conventional serial fan, the serial fan of the present invention can be simply and fastly assembled and the cost of screws or other parts can be saved. Certainly, the combination of the first and second supports is not limited to the above-described way. Both of them can be integrally formed and fixed together within the main frame.

Certainly, the rotation speed, the rotation direction, the number of blades, and the tilting angles of blades of the first rotor device can be identical to or different from those of the second rotor device. These can be adjusted according to the actual requirement and application to attain the purpose of further enhancing the heat-dissipating efficiency of the serial fan. In addition, the structures of the first and second supports can be exchanged to achieve the same effect.

Figure 2:
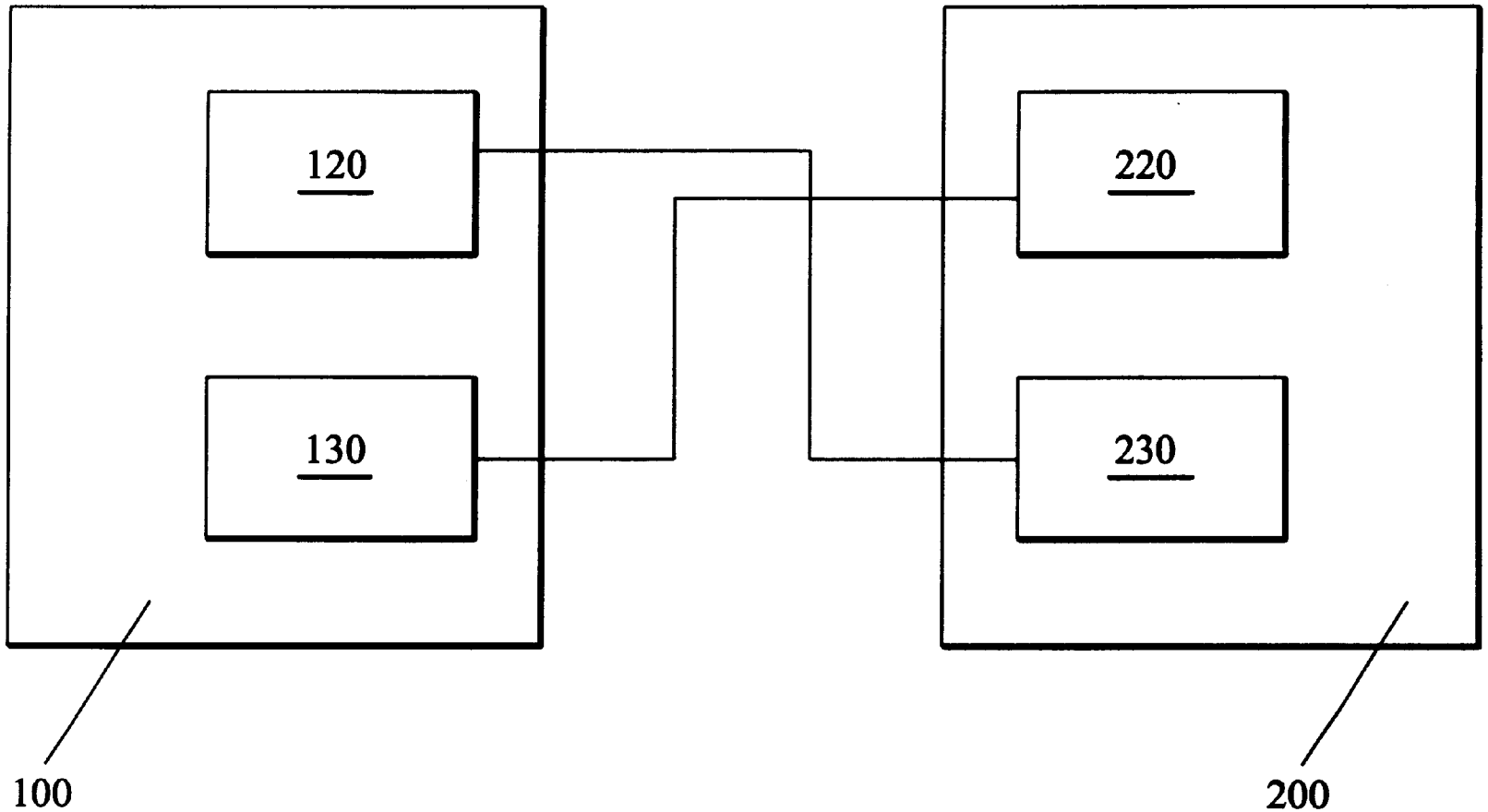
FIG. 2 is a block diagram showing the controlling method of a backup heat-dissipating system of the present invention.

According to an aspect of the present invention, when the first rotor device fails, the first control circuit will output a signal to said second control circuit for driving the second rotor device to rotate at a relatively higher speed. Now, please refer to FIG. 2, in this preferred embodiment, the first rotor device 100 further includes a first control circuit 120 and a first signal output terminal 130. Likewise, the second rotor device 200 also further includes a second control circuit 220 and a second signal output terminal 230. The first signal output terminal 130 is coupled to the second control circuit 220 and the first control circuit 120 is coupled to the second signal output terminal 230. The logic signals output from the first signal output terminal 130 and the second signal output terminal 230 indicate whether the rotation speeds of the first and second rotor devices are normal, respectively. For example, when the rotation speed is normal, the logic signal is "1"; when the rotation speed is abnormal, the logic signal is "0". Certainly, the logic signal can be set as "0" to indicate that the rotation speed is normal, and the logic signal is set as "1" to indicate that the rotation speed is abnormal.

When the first and second rotor devices are normally operated, both of them are rotated at a low speed, respectively. However, when one of them is failed, the rotation speed of the other will be increased. For example, when the first rotor device 100 is failed, the second control circuit 220 will output a signal to increase the rotation speed of the second rotor device corresponding to the logic signal output from the first signal output terminal 130 for compensating the loss of the heat-dissipating ability.

The fan units in the conventional heat-dissipating system may be electrically connected, but each of them has its own frame and independent airflow inlet and outlet. That is to say, these fan units do not have any actual connection with each other. On the contrary, according to the present invention, the fan units are not only electrically connected with each other but mechanically coupled in a single main frame to be connected in series so as to prevent the air leakage. Because the first and second rotor devices are disposed in the same frame and connected with each other in series, one can immediately increase its rotation speed while the other is failed without air leakage occurred in the failed rotor device.

In conclusion, the present invention provides a backup heat-dissipating system with a serial fan which can be assembled easily, fastly and conveniently, and has a strengthened bonding structure. Not only can it save the cost of screws or other parts but reduce the assembling time. Additionally, in the present invention, as one rotor device in the backup heat-dissipating system is failed, the other can immediately increase its rotation speed without air leakage occurred in the failed rotor device and without affecting the heat-dissipating efficiency. Moreover, the present invention provides an axial-flow fan having a plurality of rotor devices connected in series in a single fan guard (or main frame), and a plurality of guard blades radially arranged inside the main frame and fixed onto an inner surface of the main frame by each end thereof for connecting and fixing the first support 310 within the main frame 300, wherein each guard blade has a shape substantially identical to that of each of the rotor devices, which can contribute to an increase in the discharged airflow pressure of the fan for enhancing its heat-dissipating efficiency.

While the invention has been described in terms of what are presently considered to be the most practical and preferred embodiments, it is to be understood that the invention need not be limited to the disclosed embodiment. On the contrary, it is intended to cover various modifications and similar arrangements included within the spirit and scope of the appended claims which are to be accorded with the broadest interpretation so as to encompass all such modifications and similar structures.

What is claimed is:

1. A backup heat-dissipating system comprising:

a main frame;

a first rotor device disposed in said main frame and including a first control device; and a second rotor device disposed in said main frame to be coupled with said first rotor device in series along an axial direction of said main frame, and including a second control device;

wherein when said first rotor device is failed, said first control device will output a signal to said second control device for driving said second rotor device to rotate at a relatively higher speed.

2. The backup heat-dissipating system according to claim 1 wherein said first rotor device and said second rotor device respectively further include a rotor vane with a plurality of fan blades and a motor for driving said rotor vane to rotate.

3. The backup heat-dissipating system according to claim 2 wherein said main frame has a first support and a second support to respectively receive said first and second rotor devices thereon.

4. The backup heat-dissipating system according to claim 3 wherein said first and second supports respectively have a base and a hollow cylinder substantially located at a center of said base thereof for receiving said motor and said rotor vane thereon.

5. The backup heat-dissipating system according to claim 3 wherein said first and second supports are respectively connected with said main frame through a plurality of guard blades radially arranged inside said main frame and fixed onto an inner surface of said main frame by each end thereof.

6. The backup heat-dissipating system according to claim 5 wherein each of said plurality of guard blades has a shape substantially identical to that of each fan blade of said first and second rotor devices for enhancing a heat-dissipating efficiency.

7. The backup heat-dissipating system according to claim 5 wherein said first support, said main frame and said plurality of guard blades are integrally formed together.

8. The backup heat-dissipating system according to claim 7 wherein said first support, said main frame and said plurality of guard blades are made of a material selected from one group consisting of plastic and metal, respectively.

9. The backup heat-dissipating system according to claim 7 wherein said second support is detachably connected with said first support through engagement.

10. The backup heat-dissipating system according to claim 1 wherein said first and second rotor devices are axial-flow fans, respectively.

11. A backup heat-dissipating system comprising:

a main frame;

a first rotor device disposed in said main frame; and a second rotor device coupled with said first rotor device in series along an axial direction of said main frame;

wherein when said first rotor device is failed, said first rotor device will output a signal to have said second rotor device to rotate at a relatively higher speed.

12. The backup heat-dissipating system according to claim 11 wherein said first rotor device further includes a first control circuit and a first signal output terminal, and said second rotor device further includes a second control circuit and a second signal output terminal, wherein when said first rotor device is failed, said first signal output terminal will output said signal to said second control circuit for driving said second rotor device to rotate at said relatively higher speed.

13. A backup heat-dissipating system comprising:

a main frame having a first support and a second support;

a first rotor device disposed on said first support; and a second rotor device disposed on said second support to be coupled with said first rotor device in series along an axial direction of said main frame;

wherein when said first rotor device is failed, said first rotor device will output a signal to have said second rotor device to rotate at a relatively higher speed.

14. The backup heat-dissipating system according to claim 13 wherein said first rotor device further includes a first control circuit and a first signal output terminal, and said second rotor device further includes a second control circuit and a second signal output terminal, wherein when said first rotor device is failed, said first signal output terminal will output said signal to said second control circuit for driving said second rotor device to rotate at said relatively higher speed.

15. The backup heat-dissipating system according to claim 13 wherein said second support is detachably connected with said first support through engagement.

16. The backup heat-dissipating system according to claim 13 wherein said first rotor device and said second rotor device respectively further include a rotor vane with a plurality of fan blades and a motor for driving said plurality of fan blades to rotate.

17. The backup heat-dissipating system according to claim 16 wherein said first and second supports respectively have a base and a hollow cylinder substantially located at a center of said base for receiving said motor and said rotor vane thereon.

18. The backup heat-dissipating system according to claim 13 wherein said first and second supports are respectively connected with said main frame through a plurality of guard blades radially arranged inside said main frame and fixed onto an inner surface of said main frame by each end thereof.

19. The backup heat-dissipating system according to claim 18 wherein each of said plurality of guard blades has a shape substantially identical to that of each fan blade of said first and second rotor devices for enhancing a heat-dissipating efficiency.

20. The backup heat-dissipating system according to claim 19 wherein said first support, said second support, said main frame and said plurality of guard blades are integrally formed together.

* * * * *